US006745468B1

(12) United States Patent
Schmitt

(10) Patent No.: US 6,745,468 B1
(45) Date of Patent: Jun. 8, 2004

(54) METHOD OF MANUFACTURING A BOAT STEERING WHEEL WITH FINGER GRIP INDENTATIONS

(75) Inventor: Gervase G. Schmitt, Lancaster, PA (US)

(73) Assignee: Schmitt Marine Steering Wheels, Inc., Lancaster, PA (US)

( * ) Notice: Subject to any disclaimer, the term of this patent is extended or adjusted under 35 U.S.C. 154(b) by 347 days.

(21) Appl. No.: 10/055,227

(22) Filed: Jan. 23, 2002

Related U.S. Application Data

(62) Division of application No. 09/561,549, filed on Apr. 28, 2000, now abandoned.
(60) Provisional application No. 60/131,517, filed on Apr. 29, 1999.

(51) Int. Cl.[7] ..... B21D 53/30
(52) U.S. Cl. ..... 29/894.1; 29/894; 29/34 R; 72/354.2; 72/353.2
(58) Field of Search ..... 29/894.1, 894, 29/34 R; 74/552, 558; 280/778; 16/111 R; 72/354.2, 370.21

(56) References Cited

U.S. PATENT DOCUMENTS 1,294,885 A * 2/1919 Dover ..... 74/552
1,527,448 A * 2/1925 Snell ..... 74/552
1,753,586 A * 4/1930 Warwick ..... 228/144
5,186,075 A * 2/1993 Kushmaul et al. ..... 74/552
5,190,267 A 3/1993 Schmitt et al. ..... 256/59
6,170,313 B1 * 1/2001 Vasseur et al. ..... 72/312

FOREIGN PATENT DOCUMENTS

GB 1125490 * 8/1968

* cited by examiner

*Primary Examiner*—David P. Bryant
*Assistant Examiner*—Eric Compton
(74) *Attorney, Agent, or Firm*—Miller Law Group, PLLC

(57) ABSTRACT

A formed stainless steel steering wheel is produced by a process that includes starting with a linear stock of round tubing which is then formed into a generally circular shape with an oval-shaped cross-section. The two ends of the curved tubing are then welded together to form a circular blank. The blank is then placed into a circular die having forming punches associated therewith to strike the blank to form finger grip indentations therein. The circular die is then rotationally indexed so that the forming punches can form subsequent finger grip indentations around the circumference of the blank adjacent to the previously formed indentations in a predetermined pattern until the steering wheel rim is completed. By utilizing multiple, preferably three, forming punches equidistantly spaced along the circumference of the circular die, the finger grip indentations can be formed without crushing the blank. A preselected number of radially extending spokes are then welded between the formed rim and a central hub to complete the formation of the stainless steel steering wheel having a particular use on boats operated on salt water.

6 Claims, 7 Drawing Sheets

Fig. 9a
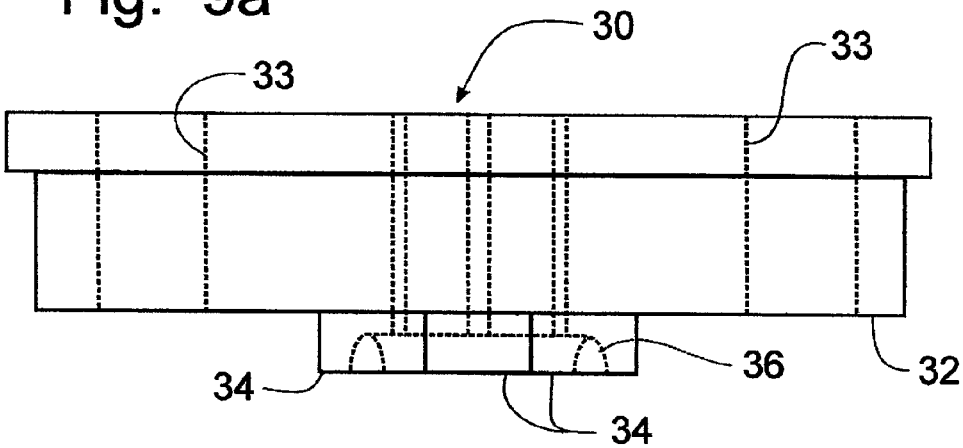
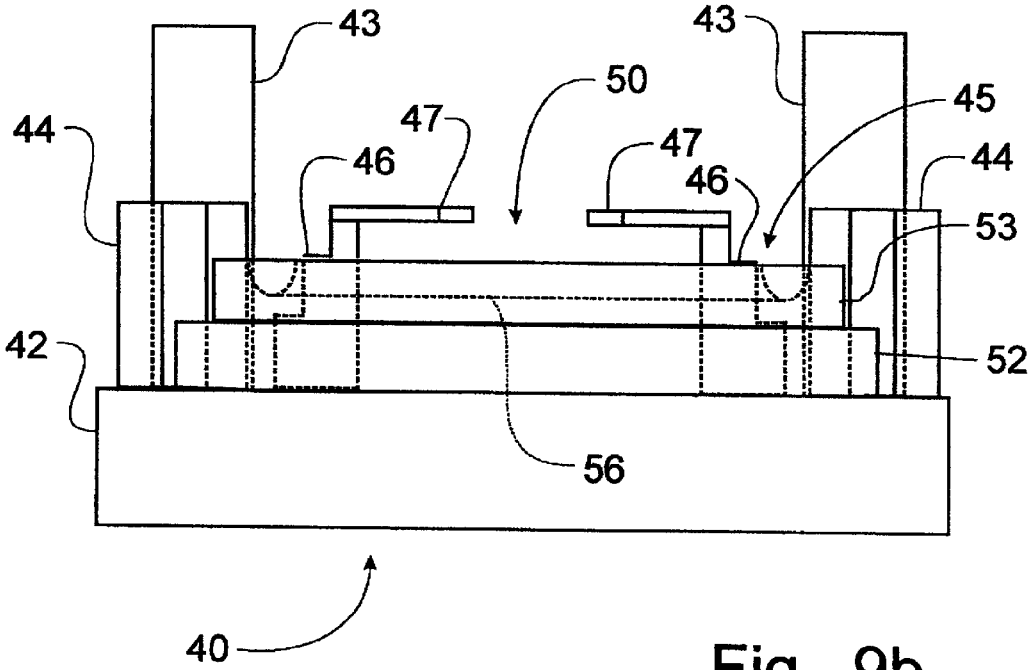
Fig. 9b

METHOD OF MANUFACTURING A BOAT STEERING WHEEL WITH FINGER GRIP INDENTATIONS

CROSS REFERENCE TO RELATED APPLICATIONS

This application is a division of U.S. patent application Ser. No. 09/561,549, filed Apr. 28, 2000 now abandoned, and claims domestic priority on U.S. Provisional Patent Application Serial No. 60/131,517, filed Apr. 29, 1999, the contents of which are incorporated herein by reference.

BACKGROUND OF THE INVENTION

This invention relates generally to a steering wheel for use on a boat and, more particularly, to a steel fabricated steering wheel having a plurality of compound indentations formed in the underside thereof for use as finger grips in operating the steering wheel.

Steering wheels are used in many applications, including automobiles and other vehicles, and boats and the like, to facilitate human control over the machine being operated. Most such steering wheels are manufactured with ridges and grooves on the underside of the steering wheel to conform the steering wheel to gripping by the human hand. Such steering wheels are typically molded from materials, such as plastic, with the finger grip indentations formed in the finished product. Fabricating a steering wheel out of tubular steel stock with similar finger grip indentations formed therein has not heretofore been known in the art. The fabrication of such a steering wheel places substantial stress on the tubular stock member and can easily cause the tubular stock to collapse.

Similar problems were encountered in the manufacture of hand railings from tubular steel stock and were addressed in U.S. Pat. No. 5,190,267, granted to Gervase A. Schmitt, et al, on Mar. 2, 1993. This prior art method and apparatus discloses the manufacture of hand railings set forth in the aforementioned U.S. Pat. No. 5,190,267 for use in a variety of different applications, none of which included the formation of a boat steering wheel bearing finger-sized indentations in the underside thereof for engagement with human fingers. This disclosure, however, does not teach one of ordinary skill in the art to manufacture a steering wheel from steel tubing stock, which would be particularly desirable for use on boats. Because of the exposure to a relatively harsh environment, including salt spray, and exposure to the sun, a material of choice for the manufacture of such steering wheels is stainless steel.

It would, therefore, be desirable to provide a steering wheel and a method of manufacture of the steering wheel in order to improve the durability and operation of a boat by replacing existing standard steering wheel devices.

SUMMARY OF THE INVENTION

It is an object of this invention to provide a formed stainless steel steering wheel that can be used on boats operated on salt water.

It is another object of this invention to provide a process of forming a stainless steel steering wheel.

It is a feature of this invention that a stainless steel steering wheel is fabricated with finger grip indentations on the bottom side thereof.

It is an advantage of this invention that an aesthetically pleasing stainless steel steering wheel can be installed on boats used in salt water operation without sacrificing the availability of finger grip indentations.

It is another advantage of this invention that the oval, tear drop shape of the cross-section of the rim of the stainless steel steering wheel facilitates a comfortable grasping of the steering wheel.

It is still another advantage of this invention that the process for manufacturing the stainless steel steering wheel forms the finger grip indentations without crushing the cross-section of the rim.

It is another feature of this invention that the manufacturing process involves the use of multiple forming punches simultaneously forming finger grip indentations at each indexed strike of the punches into the blank from which the rim is formed.

It is still another feature of this invention that the multiple forming punches are equidistantly spaced around the circumference of the circular tool at spacings at least the spacings of two finger grip indentations so that a limited amount of force is exerted on the blank at any die strike to prevent the cross-section of the blank from collapsing.

It is still another object of this invention to provide a method of manufacturing a stainless steel steering wheel having finger grip indentations on one side thereof involving the steps of:

a. placing a circular blank having an oval-shaped cross-section defining an elongated axis into a tool having a circular die;

b. striking the blank simultaneously with multiple forming punches spaced equidistantly along the circumference of said circular die, each said forming punch being formed with a compound curved shape to form an indentation axially into one side of said blank;

c. then, indexing the blank circumferentially relative to said forming punches to position said blank for a subsequent formation of a new indentation into said blank; and d. repeating said striking and indexing steps until said one side is formed with a desired number of indentations having a defined spacing in a predetermined pattern, placing a circular blank having an oval-shaped cross-section defining an elongated axis into a circular tool.

It is yet another object of this invention that the formation of the blank from which the circular rim into which the finger grip indentations are formed involves the steps of:

a. inserting a round stock of linear stainless steel tubing, having a pair of distal ends, into a first tool to convert the tubing into a generally circular shape having an oval-shaped cross-section defining an elongated axis, the two distal ends being located adjacent one another; and b. welding the two distal ends together to form the circular blank.

It is a further object of this invention to provide a stainless steel steering wheel having finger grip indentations which is durable in construction, inexpensive of manufacture, carefree of maintenance, facile in assemblage, and simple and effective in use and a process for making such a steering wheel.

These and other objects, features and advantages are accomplished according to the instant invention by providing a formed stainless steel steering wheel formed by a process that includes starting with a linear stock of round tubing which is then formed into a generally circular shape with an oval-shaped cross-section. The two ends of the curved tubing are then welded together to form a circular blank. The blank is then placed into a circular die having forming punches associated therewith to strike the blank to form finger grip indentations therein. The circular die is then rotationally indexed so that the forming punches can form subsequent finger grip indentations around the circumference of the blank adjacent to the previously formed indentations in a predetermined pattern until the steering wheel rim is completed. By utilizing multiple, preferably three, forming punches equidistantly spaced along the circumference of the circular die, the finger grip indentations can be formed without crushing the blank. A preselected number of radially extending spokes are then welded between the formed rim and a central hub to complete the formation of the stainless steel steering wheel having a particular use on boats operated on salt water.

BRIEF DESCRIPTION OF THE DRAWINGS

The advantages of this invention will become apparent upon consideration of the following detailed disclosure of the invention, especially when taken in conjunction with the accompanying drawings wherein:

FIG. 9*a* is a front elevational view of the upper portion of the tool shown in FIG. 8*a;*

FIG. 9*b* is a front elevational view of the bottom portion of the tool shown in FIG. 8*b*.

DETAILED DESCRIPTION OF THE PREFERRED EMBODIMENT

Figure 1:
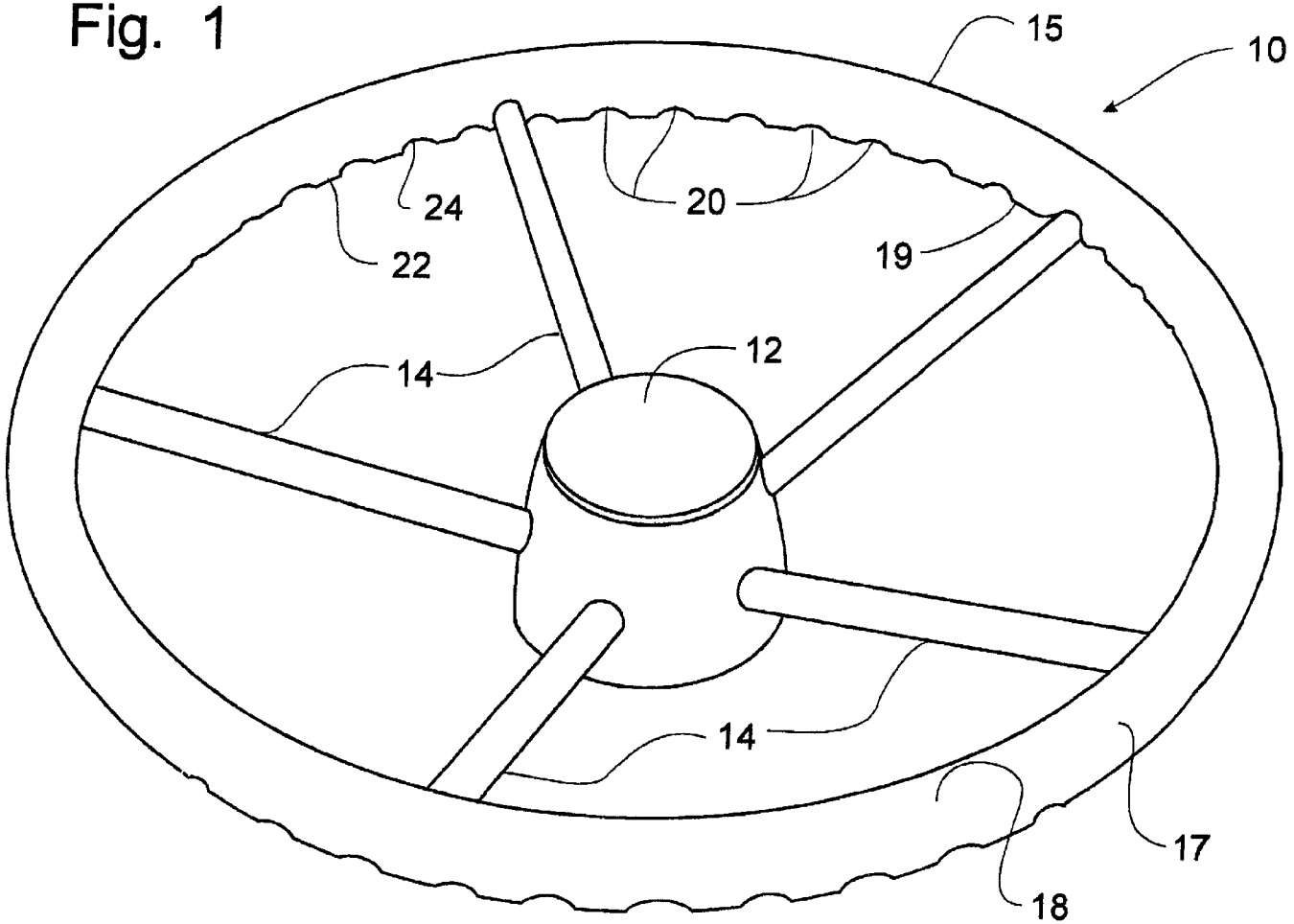
FIG. 1 is a top perspective view of a steering wheel for use on a boat, incorporating the principles of the instant invention.
Figure 2:
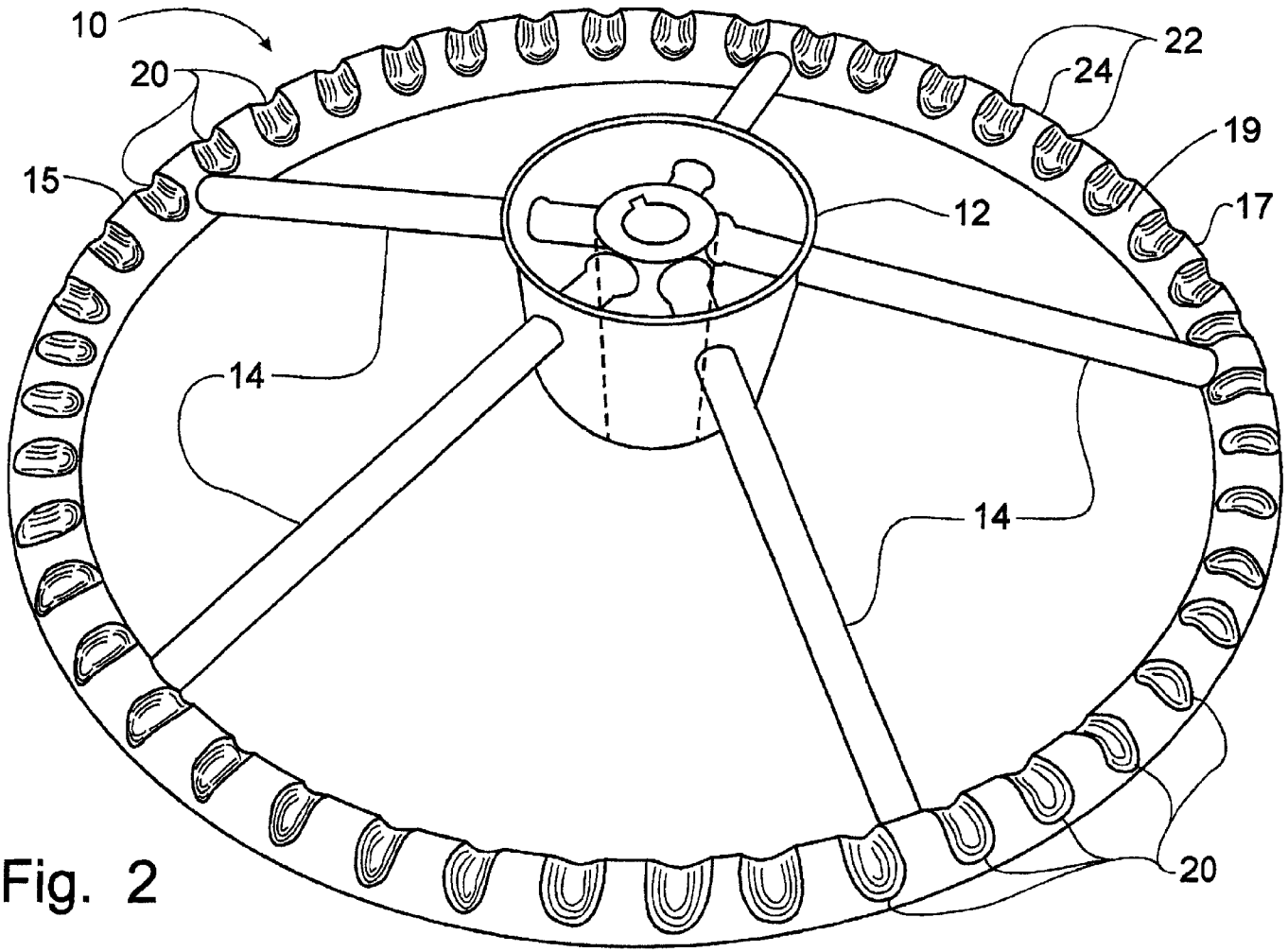
FIG. 2 is a bottom perspective view of the steering wheel shown in FIG. 1, depicting the underside of the steering wheel in which the finger grip indentations are formed.

Referring now to FIGS. 1 and 2, a steering wheel manufactured from stainless steel and incorporating finger grip indentations in accordance with the principles of the instant invention can best be seen. The steering wheel 10 is formed from a central hub 12 which is connected to the steering mechanism of the boat (not shown) in a conventional manner such that a conventional rotation of the steering wheel 10 will effect the desired steering of the boat. Radiating outwardly from the hub 12 are a plurality of spokes 14 that support the rim portion 15 from the hub 12. Manufacturing the rim portion 15 with finger grip indentations 20 is the desired feature of the instant invention. The hub 12 can be manufactured in any one of many different configurations. Likewise, the spokes 14 can varying is size, shape and number so long as the spokes 14 support the rim 15 for manipulation by the operator.

The rim 15 is formed with an elongated body portion 17 which preferably has an ergonomically appealing and comfortable oval or tear-drop cross-sectional shape. The top portion 18 of body portion 17 is smooth in a conventional manner, while the bottom portion 19 is formed with a series of finger grip indentations 20 substantially equally spaced around the rim 15. The rim 15 is formed in a curved, preferably circular, configuration, which requires the indentations 20 to be formed in a radial manner with respect to the center of curvature of the rim 15, which corresponds to the hub 12. The series of indentations 20 creates alternating ridges 22 and valleys 24 to form finger-sized gripping surfaces to facilitate gripping of the steering wheel 10.

The manufacturing tool or die is best seen in FIGS. 8*a*–10 and is somewhat similar to the die shown and described in the specification of U.S. Pat. No. 5,190,267, the description of which is incorporated herein by reference, except that the die is curved to correspond to the desired curved or circular configuration of the rim 15. The tool includes opposing first and second mating members 30, 40 which support the body portion 17 of the rim and define an oval or tear-drop shaped cavity within the die. The tool has preferably three key-like forming punches 59 equidistantly spaced along the circumference of the tool. The manufacturing operation will form three finger grip indentations on each stroke of the tool to press the punches 59 into the tubular stock within the die.

The top portion 30 of the die includes a base member 32 supporting three die blocks 34 having an oval-shaped groove 36 formed therein. Each die block 34 includes a generally vertical opening 35 through the die block 34 and the base member 32 for the passage of a forming punch 59. The three die blocks 34 are detachably fixed to the base member 32 so that the openings 35 are equidistantly spaced and arranged to form a finger grip indentation in the associated blank at a spacing at least two indentations apart. By spacing the formation of the indentations, the blank will not be crushed by the forming punches 59 pressing into the blank. The base member 32 is also provided with a pair of oppositely spaced pillar openings 33 that are alignable with corresponding pillars on the bottom portion 40 of the die, as described in greater detail below.

The bottom portion 40 of the tool is formed on a base member 42. A pair of oppositely positioned pillars 43 project upwardly for engagement with the pillar openings 33 in the top portion 30 when the die is assembled to ensure proper alignment of the two mating halves 30, 40 of the tool. The bottom portion 40 is also provided with a pair of laterally spaced stop blocks 44 positioned at an appropriate height to stop the movement of the top portion 30 when the mating halves 30, 40 are assembled for operation. Similarly, the bottom portion is provided with a pair of cantilevered stop levers 45 positioned between the stop blocks 44. The stop levers 45 have a base portion 46 detachably connected to the base member 42 and a lever portion that extends outwardly therefrom in a cantilevered manner over the interior portion of the circular die 50. The stop levers 45 also serve to support the top portion 30 of the tool in the proper orientation over the bottom portion 40.

The bottom portion 40 also includes a circular die 50 that is formed with a apertured outer ring 52 and a segmented inner portion 53. The inner portion 53 includes a circular oval-shaped groove 56 positioned near the apertured outer ring 52. The inner portion 53 is formed of individual pie-shaped segments 54 to facilitate the manufacture and assembly of the circular die 50. Each segment 54 is provided with a keyhole-shaped opening 58 therein to permit the mounting of clamps (not shown) that engage the blank rim positioned in the groove 56 to maintained position thereof relative to the die 50 during operation thereof. The circular die 50 is rotated by a drive mechanism (not shown) that engages the apertured ring 52 and indexes the circular die as defined by the aperture spacing after each finger grip indentation is formed by the forming punches. The clamps (not shown) must be relocated as the circular die 50 is rotatably indexed to prevent interference between the clamps (not shown) and the cantilevered levers and/or the die blocks 34.

Figure 10:
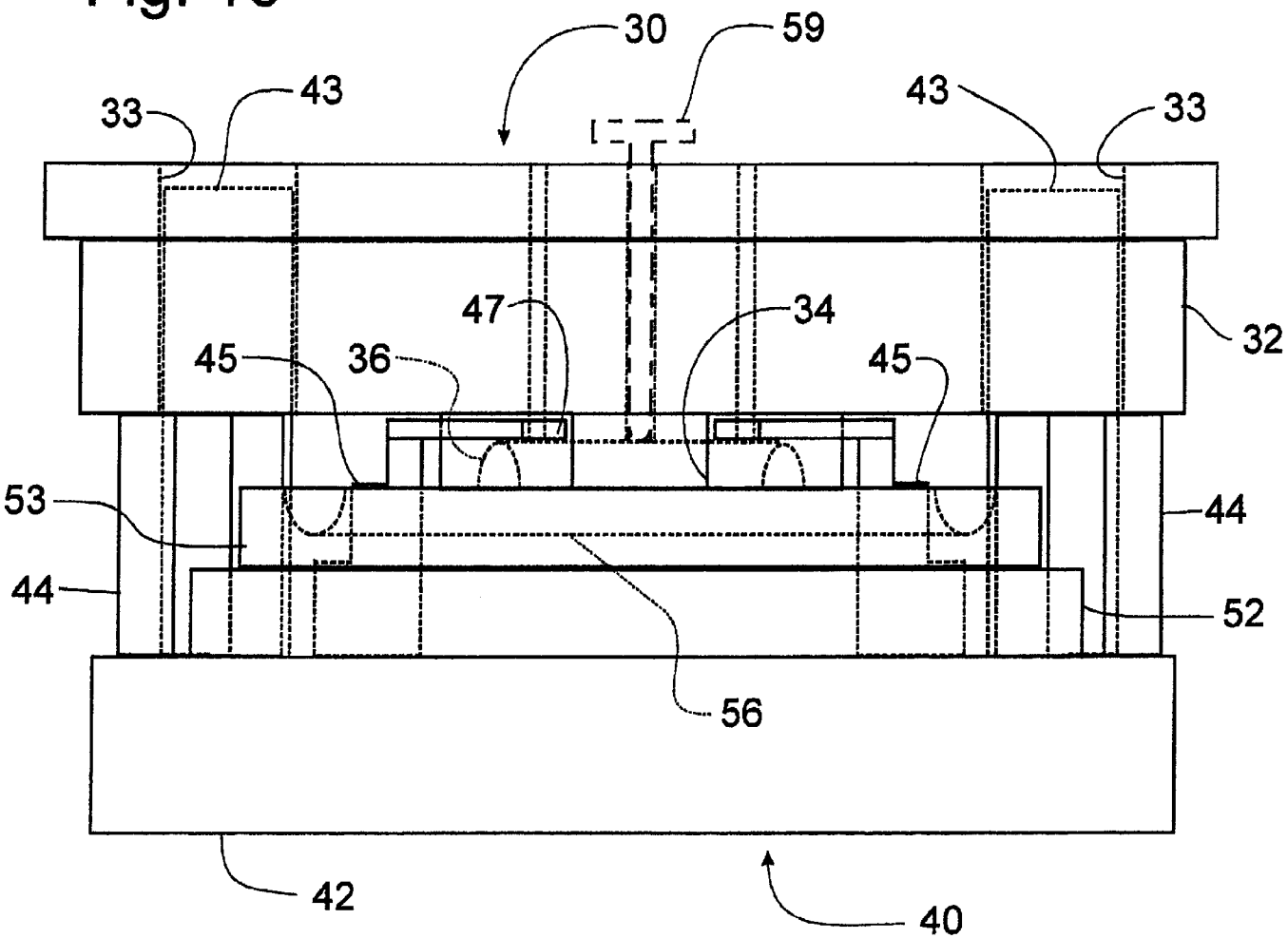
FIG. 10 is a front elevational view of the tool assembled with the upper portion placed on the bottom portion for operation in forming the finger grip indentations in a steering wheel blank, a representative forming punch being shown in phantom.

With the tool assembled as depicted in FIG. 10, the first three finger grip indentations are formed with the first stroke of a conventional press (not shown) into which the tool is operably positioned. The die is then indexed to form another set of three indentations around the circumference of the rim blank. The subsequent sequential indexing and pressing are repeated until the entire circumference of the rim has been completely formed with the indentations. It is important to note that the formation of the indentations in a sequential pattern is critical to the manufacturing of the rim 15 from thin walled stainless steel tubular stock as the tubular stock will crush or collapse if the indentations are all formed in one stroke of the tool.

Figure 3:
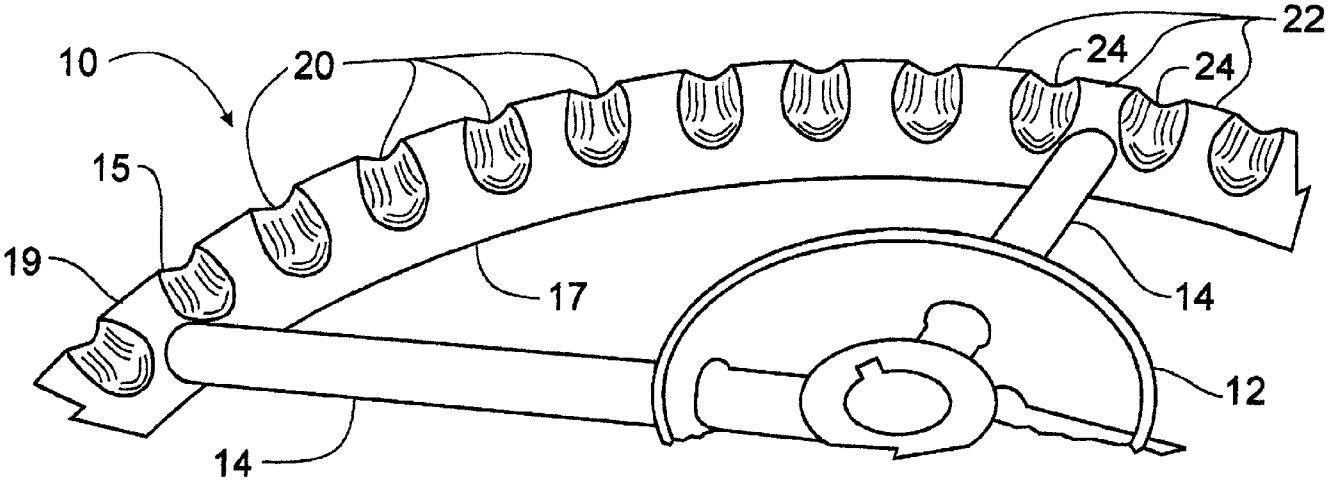
FIG. 3 is an enlarged perspective view of a portion of the underside of the steering wheel depicted in FIG. 2, showing the finger grip indentations.
Figure 4:
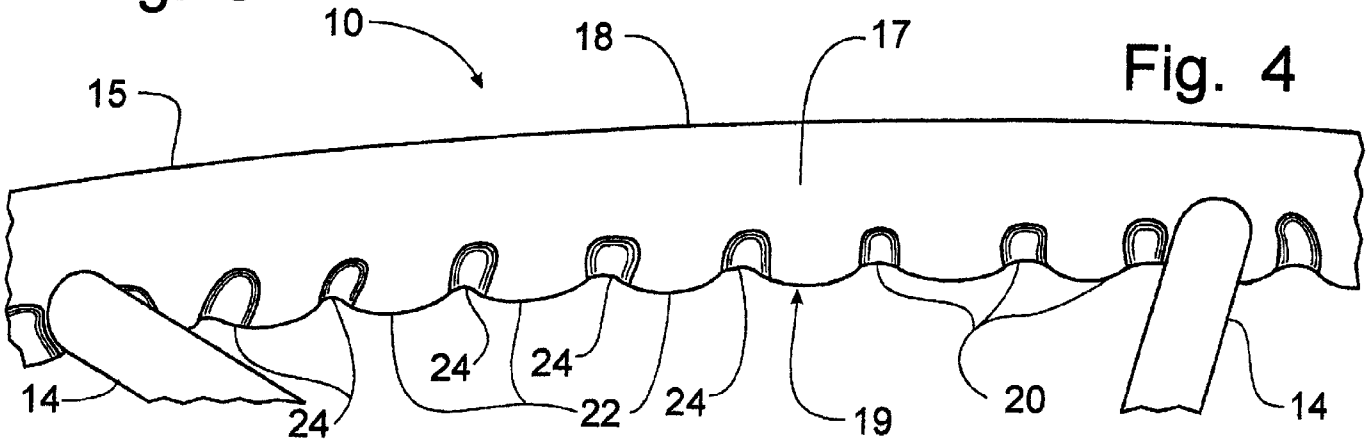
FIG. 4 is an enlarged perspective view of a portion of the top side of the steering wheel depicted in FIG. 1, depicting the finger grip indentations in a side view.
Figure 5:
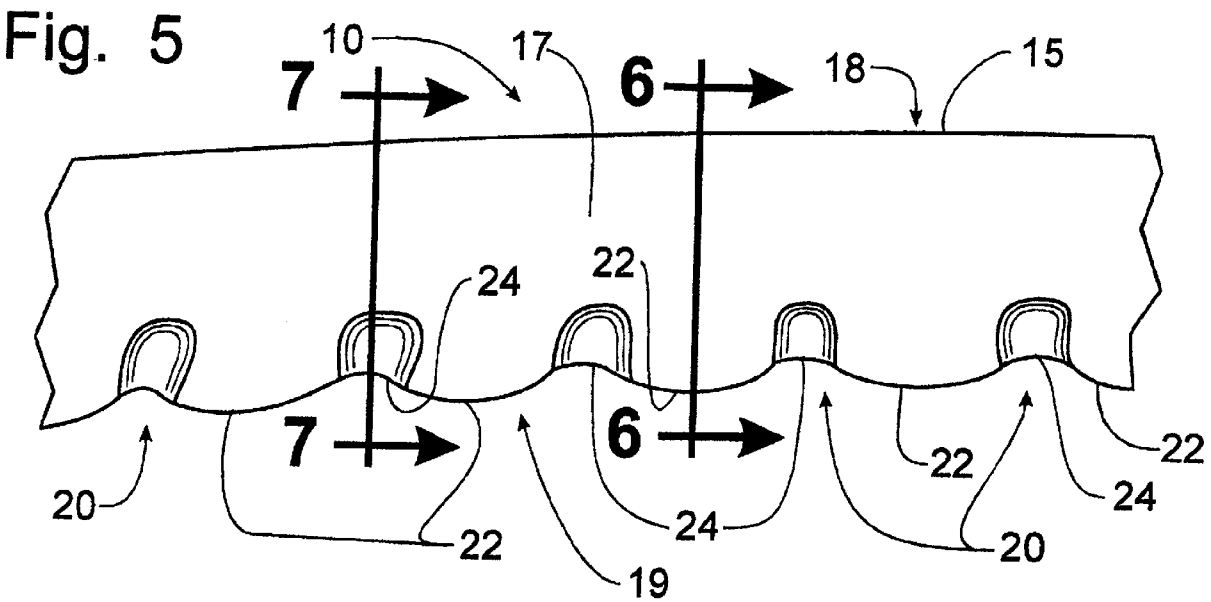
FIG. 5 is an enlarged elevational view of a portion of the steering wheel depicted in FIG. 4 to depict a side elevational view of the finger grip indentations.
Figure 7:
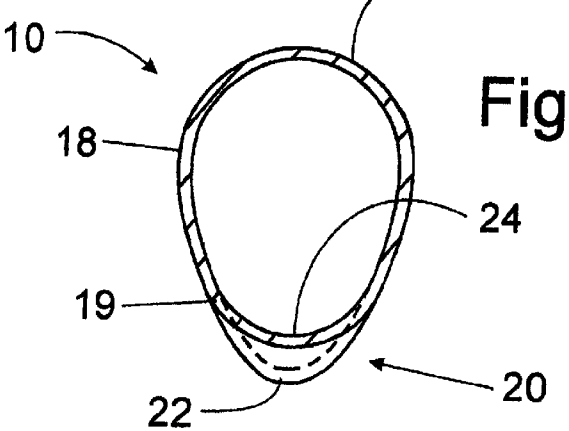
FIG. 7 is an enlarged cross-sectional view of the rim of the steering wheel taken along lines 7—7 of FIG. 5 passing through a finger grip indentation.
Figure 6:
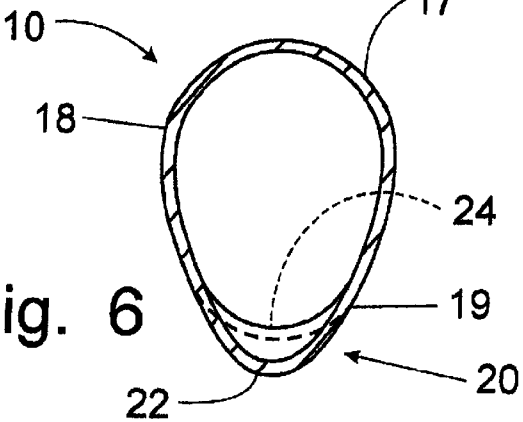
FIG. 6 is an enlarged cross-sectional view of the rim of the steering wheel taken along lines 6—6 of FIG. 5 passing through a ridge between adjacent finger grip indentations.

The tips of the punches 59 are formed with a compound curvature formed from a combination of a first convex curved surface and a second concave curved surface, as described in the aforementioned U.S. Pat. No. 5,190,267, except that the punches are flared slightly to center the formed indentations radially with respect to the center 12 of the rim 15. As best seen in FIGS. 3–5, the compound shape of the tip portion creates the finger-shaped indentations 20 during the manufacturing process that form valleys 24 that extend upwardly from the bottom surface 19 upwardly along the sides of the rim 15 approximately half way toward the top portion 18.

Figure 8B:
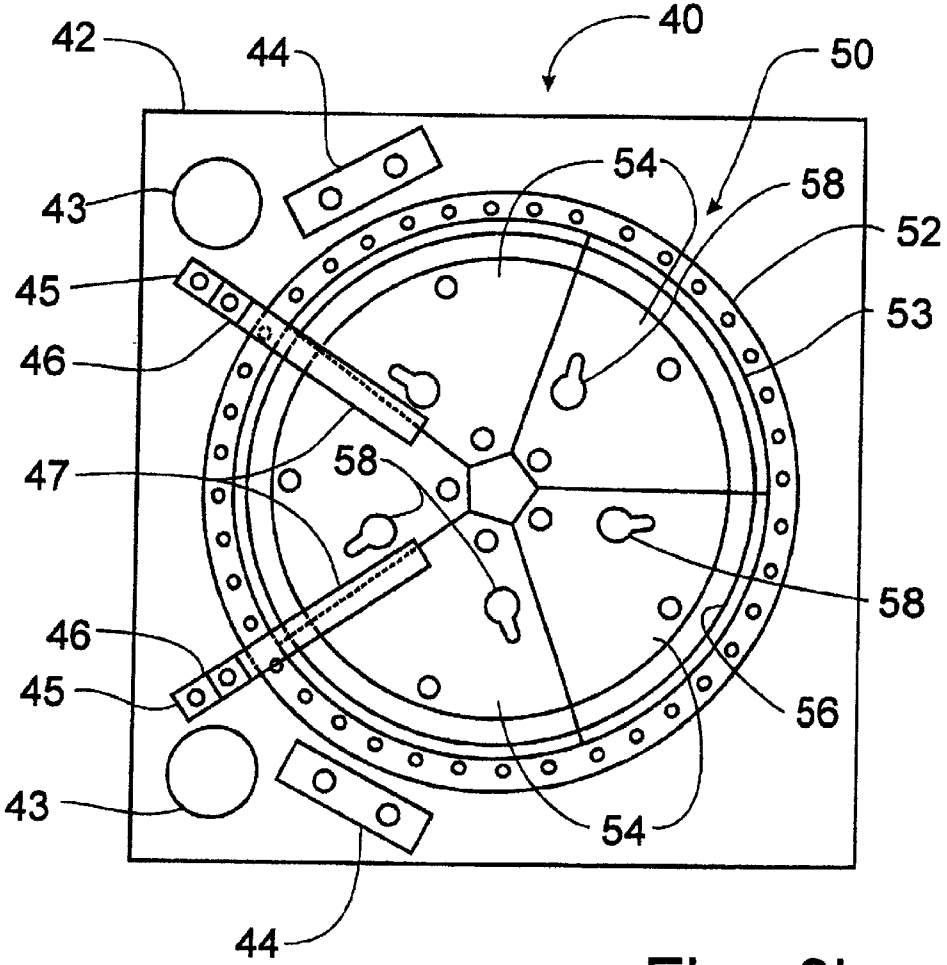
FIG. 8*b* is a top plan view of the bottom portion of a tool forming the die in which the steering wheel rim blank is positioned to have the finger grip indentations formed therein.
Figure 8A:
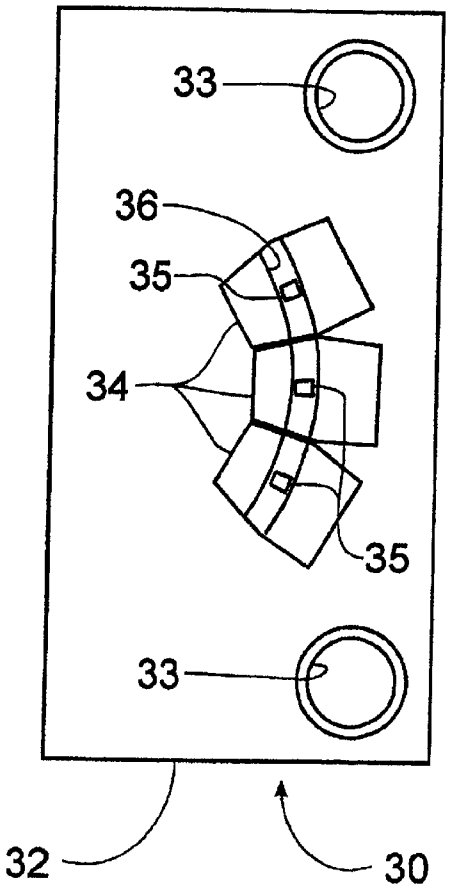
FIG. 8*a* is a bottom plan view of the upper portion of a tool through which forming punches are passed to create the finger grip indentations into a steering wheel rim blank.

The manufacturing process starts with linearly-extending, standard, round tubular metal stock, preferably thin walled stainless steel tubing. The first step of the manufacturing process is to form the round tubular stock into a curved or circular configuration, which is accomplished with a conventional forming tool that curves the standard tubular stock. This process also effects a oval or tear-drop shape to the cross-section of the stock, changing it from its initial round shape. The ends of the curved tubular stock are then welded together and then smoothed to form a circular rim blank. The circular blank is then moved to the aforementioned tool and die, as best seen in FIGS. 8–10, to form the indentations 20 which completes the manufacturing of the rim 15. To complete the manufacturing of the steering wheel 10, the hub 12 and spokes 14, in whatever desired configuration, are then welded onto the rim 15 with the welds smoothed out to form an aesthetically seamless stainless steel steering wheel 10 with a rim 15 having finger grip indentations 20. Alternatively, the indentations 20 do not have to be formed around the entire circumference of the rim 15, placing the indentations 20 in only desired sections or segments of the circumference.

The resultant steering wheel 10 provides a stainless steel steering wheel for use in harsh salt water environments while providing a steering wheel 10 with an ergonomic grip area for both the fingers and hands of the operator, resulting in a more positive grip and better control of the steering wheel 10 and less fatigue for the operator. The steering wheel 10 can also be manufactured from polished steel tubing, powder coated or painted steel tubing or coated steel tubing. One skilled in the art will recognize a uniquely appearing steering wheel having an aesthetic appearance for formed or fabricated metal steering wheels heretofore unknown in the art.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A method of manufacturing a stainless steel steering wheel rim comprising the steps of:

placing a tubular steel circular blank having an oval-shaped cross-section defining an elongated axis into a tool having a circular die;

striking the outside surface of the tubular steel blank simultaneously with multiple forming punches spaced equidistantly along the circumference of said circular die, each said forming punch being formed with a compound curved shape to form an indentation axially into one side of said blank;

then, indexing the blank circumferentially relative to said forming punches to position said blank for a subsequent formation of a new indentation into said blank; and repeating said striking and indexing steps until said one side is formed with a desired number of indentations having a defined spacing in a predetermined pattern.

2. The method of claim 1 further comprising the step of:

forming said circular blank by the steps of:

a. inserting a round stock of linear stainless steel tubing, having a pair of distal ends, into a first tool to convert said tubing into a generally circular shape having said oval-shaped cross-section defining said elongated axis, the two distal ends being located adjacent one another; and b. welding said two ends together to form a circular blank.

3. The method of claim 2 further comprising the step of welding a plurality of spokes interconnecting a central hub and said blank after the formation of said indentations has been completed.

4. The method of claim 1 wherein said multiple forming punches are located circumferentially around said circular die at a distance greater than the spacing of two indentations.

5. The method of claim 4 where each of said multiple forming punches is associated with a die block affixed to an upper portion of the tool operatively positioned above said circular die.

6. The method of claim 5 wherein each said indexing step includes a rotational movement of said circular die relative to said die blocks equal to a multiple of a desired spacing between indentations to locate subsequent indentations in said predetermined pattern.

* * * * *